US006216916B1

(12) United States Patent
Maddox et al.

(10) Patent No.: US 6,216,916 B1
(45) Date of Patent: Apr. 17, 2001

(54) COMPACT FLUID PUMP

(75) Inventors: Jeffrey T. Maddox, Hudson; Rexford R. Mast, Wooster; Robert H. Yeager, Twinsburg, all of OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 09/397,314

(22) Filed: Sep. 16, 1999

(51) Int. Cl.[7] ..... B65D 33/56

(52) U.S. Cl. ..... 222/105; 222/183; 222/207; 222/214

(58) Field of Search ..... 222/207, 214, 222/181.3, 181.2, 105, 95, 183, 209, 156, 158, 159

(56) References Cited

U.S. PATENT DOCUMENTS

| | | | | |
|---|---|---|---|---|
| 2,753,091 | | 7/1956 | Herzig | 222/491 |
| 3,118,468 | | 1/1964 | Bochan | 137/525.1 |
| 3,610,477 | | 10/1971 | Herzig | 222/213 |
| 3,777,941 | | 12/1973 | Riddle | 222/207 |
| 3,820,689 | | 6/1974 | Cocita | 222/207 |
| 3,931,831 | | 1/1976 | French | 137/525 |
| 3,935,975 | | 2/1976 | Gauntlett | 222/490 |
| 3,987,938 | * | 10/1976 | Cooprider et al. | 222/207 |
| 3,991,916 | | 11/1976 | Del Bon | 222/402.13 |
| 4,101,057 | | 7/1978 | LoMaglio | 222/207 |
| 4,131,135 | | 12/1978 | Aleff | 137/856 |
| 4,515,294 | * | 5/1985 | Udall | 222/207 X |
| 4,524,805 | | 6/1985 | Hoffman | 137/846 |
| 4,570,827 | | 2/1986 | Roggenburg, Jr. | 222/491 |
| 4,621,749 | | 11/1986 | Kanfer | 222/153 |
| 4,886,192 | * | 12/1989 | Cassia | 222/214 X |
| 4,921,136 | | 5/1990 | Roggenburg, Jr. | 222/95 |
| 5,099,885 | | 3/1992 | Nilsson | 137/852 |
| 5,100,030 | | 3/1992 | Roggenburg, Jr. | 222/181 |
| 5,176,510 | | 1/1993 | Nilsson | 417/479 |
| 5,207,355 | | 5/1993 | Thomsen | 222/95 |
| 5,265,772 | | 11/1993 | Bartasevich et al. | 222/214 |
| 5,271,432 | | 12/1993 | Gueret | 137/854 |
| 5,360,145 | | 11/1994 | Gueret | 222/190 |
| 5,413,250 | | 5/1995 | Gueret | 222/105 |
| 5,439,144 | | 8/1995 | Holzner | 222/189.06 |
| 5,443,236 | | 8/1995 | Bell et al. | 248/311.3 |
| 5,454,488 | | 10/1995 | Geier | 222/95 |
| 5,465,877 | | 11/1995 | Bell et al. | 222/181.2 |
| 5,632,418 | | 5/1997 | Brown | 222/180 |
| 5,697,525 | | 12/1997 | O'Reilly et al. | 222/105 |
| 5,772,079 | | 6/1998 | Gueret | 222/321.7 |
| 5,806,717 | | 9/1998 | De Rosenzieg-Page et al. | 222/105 |

FOREIGN PATENT DOCUMENTS

| | | | |
|---|---|---|---|
| 1262528 | 2/1972 | (GB) | 21/2 |
| WO98/08661 | 3/1998 | (WO) . | |

* cited by examiner

*Primary Examiner*—Philippe Derakshani
*Assistant Examiner*—Thach H Bui
(74) *Attorney, Agent, or Firm*—Reese Taylor

(57) ABSTRACT

A pump for dispensing fluid from a dispenser includes a base in fluid communication with a source of fluid carried by the dispenser and with the atmosphere. The pump includes a base attachable to the source of fluid, a flexible transparent dome attachable to the base in overlying relationship therewith and in fluid-tight relationship, and a retainer attachable to the base in partial overlying relationship with the dome to retain the dome on the base. The pump also includes valves for selectively opening and closing the pump to fluid communication with the source of fluid and the ambient atmosphere.

22 Claims, 4 Drawing Sheets

COMPACT FLUID PUMP

RELATED PATENT APPLICATIONS

None.

FIELD OF THE INVENTION

This invention relates in general to pumps for dispensing fluids from a source or reservoir and relates in particular to a pump for dispensing soap, lotion or similar skin care products onto the hand of the user from a wall-mounted dispenser carrying the reservoir.

BACKGROUND OF THE INVENTION

Wall-mounted dispensers for soap, lotion and hand care products in general are well known in the art. These generally consist of a wall-mounted cabinet or dispenser per se with a chamber for receipt of refills or cartridges containing the soap or other product. For purposes of simplicity throughout, "soap" will be used to describe the product being dispensed with it being understood that other skin care products can be and are dispensed in this fashion and, also, that the present invention is not limited to apparatus for dispensing skin care products per se inasmuch as other flowable products may also be dispensed with the present pump.

The dispensers of the prior art, as noted, generally include the dispenser which includes a base mountable on a wall or counter top and a cover, usually hinged to the base to provide access to the interior. The base includes various types of receptacles or shelves designed to support and position a cartridge, bag or box which itself contains the soap and which is replaceable so that the dispenser can be refilled when the supply is exhausted.

These cartridges or refills take various shapes and forms in the prior art. Perhaps the most common currently used are the so-called "bag-in-box" arrangements which include a collapsible bag, which actually contains the soap, and a box for storage and transportation of the bag. The box has a tearaway portion on one face and is simply placed inside the dispenser when needed, following which the tearaway portion is removed and the soap is dispensed from the bag through an elongate tube or pump which extends downwardly from the bag and terminates in a nozzle which, when properly positioned, projects from the bottom of the dispenser. In this way, soap may be dispensed onto the hand of the user, generally by utilization of a hand-operated lever which compresses the tube pump. The most common forms of the prior art involve a lever which is engaged by either the heel of the hand to depress and activate the pump or tube to dispense the fluid onto the palm and fingers of the hand, or by the fingers of the hand to pull the lever toward the user to similarly depress and activate the pump and dispense the soap.

All of these arrangements involve some sort of nozzle and pump arrangement which generally include various types of valving to control flow of the soap by opening the tube to the reservoir or cartridge to fill it and then closing off the reservoir or cartridge and opening a valve to the nozzle to permit the soap to actually be dispensed. It is desirable in most instances to dispense a measured charge of the soap with each actuation of the handle and, therefore, the tube/pump is generally elongate so as to accommodate a "charge" of the product. Examples of this prior art can be readily seen in many U.S. patents, such as, for example, Bartasevich U.S. Pat. No. 5,265,772; Bell U.S. Pat. No. 5,443,236; Bell U.S. Pat. No. 5,465,877; and Kanfer U.S. Pat. No. 4,621,749. The prior art contains many other variations on this general theme.

In general, the prior art of this general nature has in common the fact that the elongate tube extends from the bag or other reservoir and terminates in a nozzle which projects from the bottom of the dispenser. The soap is dispensed by engaging a pressure member, as above described, which presses against the tube with the tube serving as the actual pump to expel a measured charge of the material through the nozzle.

As can be seen in the prior art just referred to and other prior art well known to those versed in this art, the dispensers themselves are of a relatively standard overall size because they must fit in a fairly confined space in a washroom or restroom. This size, of course, has a bearing on the size of the refill or cartridge, and thus on the amount of soap, which can be stored within the dispenser. A review of the references referred to above and the other prior art well known in this field will show that the elongate tube occupies a fairly significant portion of the overall interior height dimension of the dispenser. To some extent, at least from the standpoint of how much soap can be stored at a given time, this space is wasted because the major portion of the soap is stored in the bag.

Furthermore, the various valving arrangements and the tube and its associated fitments are relatively expensive to manufacture and are also somewhat labor-intensive to assemble.

Additionally, the bags are generally transparent and many of the prior art dispensers are provided with a sight window in the cover, thus enabling one to view the bag and, theoretically, to ascertain when the bag is empty. However, in practice, the sight window must be located fairly high up on the cover, and thus, one can only ascertain when the supply is low and not when the bag is empty. That requires opening the cover to view the bag which, unless the bag is truly empty, is a wasted operation.

Accordingly then, it is believed that an improvement can be made by reducing the size of the actual "pump" structure to replace the tubes of the prior art, thereby enabling a dispenser of a standard size to provide more interior space so that a greater quantity of soap can be stored, thereby reducing the number of refill replacement operations required over the life of the dispenser.

Furthermore, by utilizing a clear, collapsible dome to perform the pumping operation, one can ascertain when the bag is empty without unnecessarily opening the cover.

SUMMARY OF THE INVENTION

It has been found that this and other objects of the invention can be achieved by producing a pump for use with a source of fluid, such as a bag or cartridge, which includes a base having first and second connectors, one of which is in fluid communication with the bag and another of which is in fluid communication with a nozzle, with a flexible pressure member or dome affixed to and overlying the base so that, upon depression of the pressure member toward the base, either by direct contact with the hand of the user or by means of a handle or pressure lever engaging the flexible pressure member, the contents of the pump can be expelled through the nozzle.

It has further been found that, by providing first and second valve means, the connector in fluid communication with the bag can be closed off upon depression of the pressure member and the connector leading to the hand of the user through the nozzle can be opened.

It has further been found that release of pressure on the flexible pressure member will close off the second valve means and open the first connector which is in fluid communication with the bag or reservoir to draw a new charge of material into the chamber formed by the base and the flexible pressure member.

It has further been found that improved valve means can be employed by providing a cage consisting of one or more ribs on the base with a ball received loosely within the cage thus formed so that, upon depression of the pressure member, the inlet will be closed off by the pressure thus created against the ball and, upon release, the ball may unseat within the confines of the cage to free up the first connector opening to permit refilling of the chamber. The cage or ribs keep the ball in a relatively confined space so that it will readily reseat when needed.

It has further been found that improved fluid-tight sealing can be achieved by providing mating rib and groove means on a peripheral shoulder of the pressure member and the base so that the pressure member may snap or press fit snugly on the base and by providing a retaining ring having rib and groove means for engagement with the base and the shoulder of the pressure member whereby a secure fluid-tight seal can be achieved when the pump is assembled.

It has further been found that the nozzle can be securely attached to the second connector by providing ribs on the projecting end of the second connector, which leads to the hand of the user, and mating grooves on the interior of the nozzle so that the nozzle may also be snap fit on the second connector in solid, fluid-tight condition.

Accordingly, production of an improved fluid pump of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
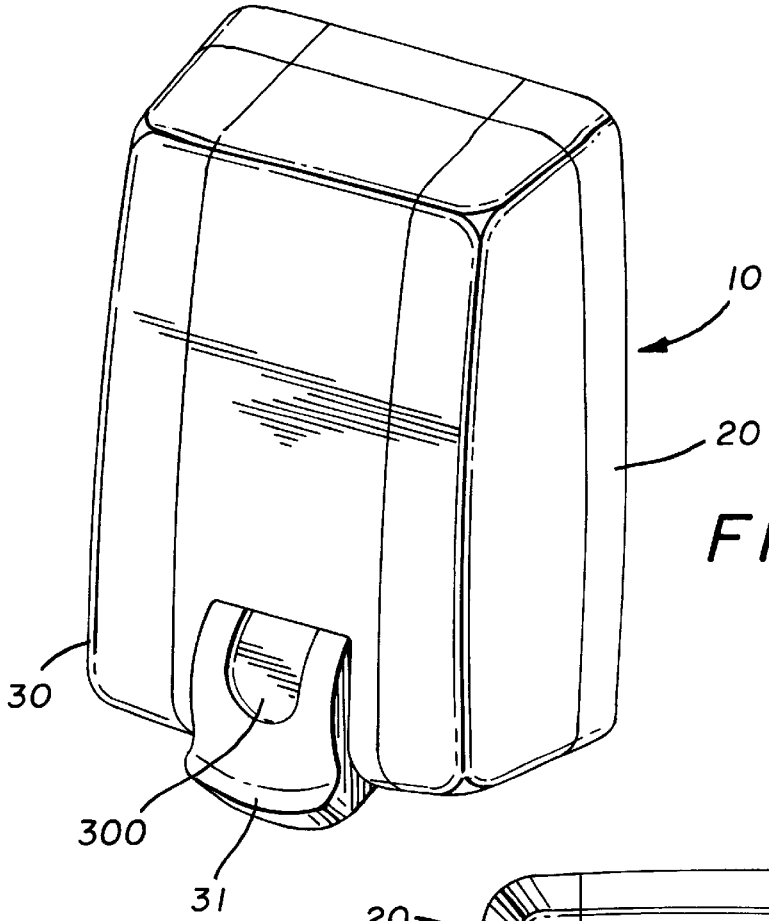
FIG. 1 is a perspective view of a dispenser for use with the pump of the present invention.
Figure 2:
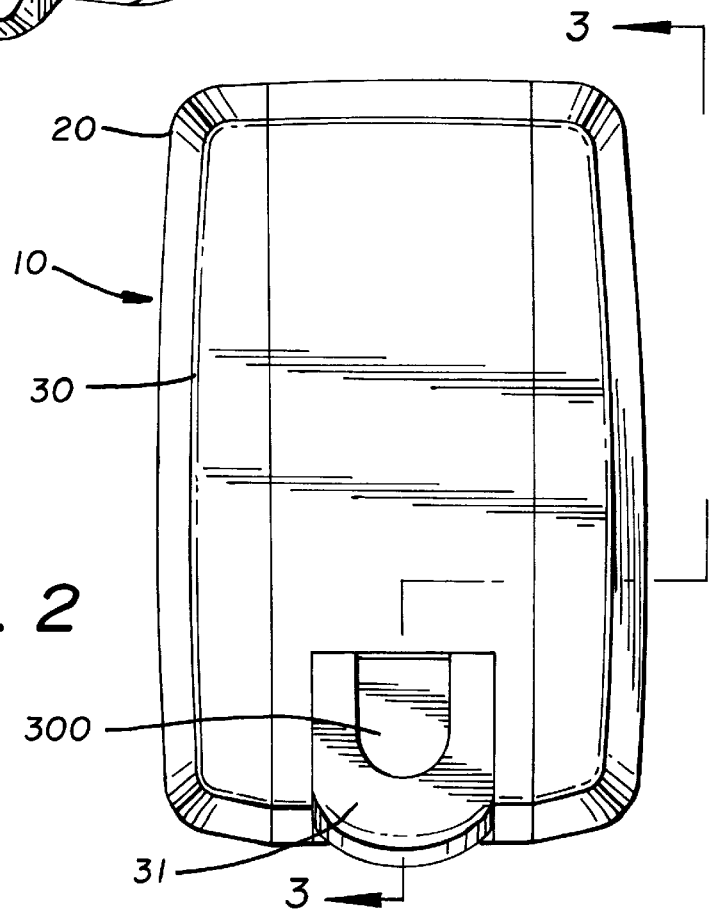
FIG. 2 is an elevational view thereof.
Figure 3:
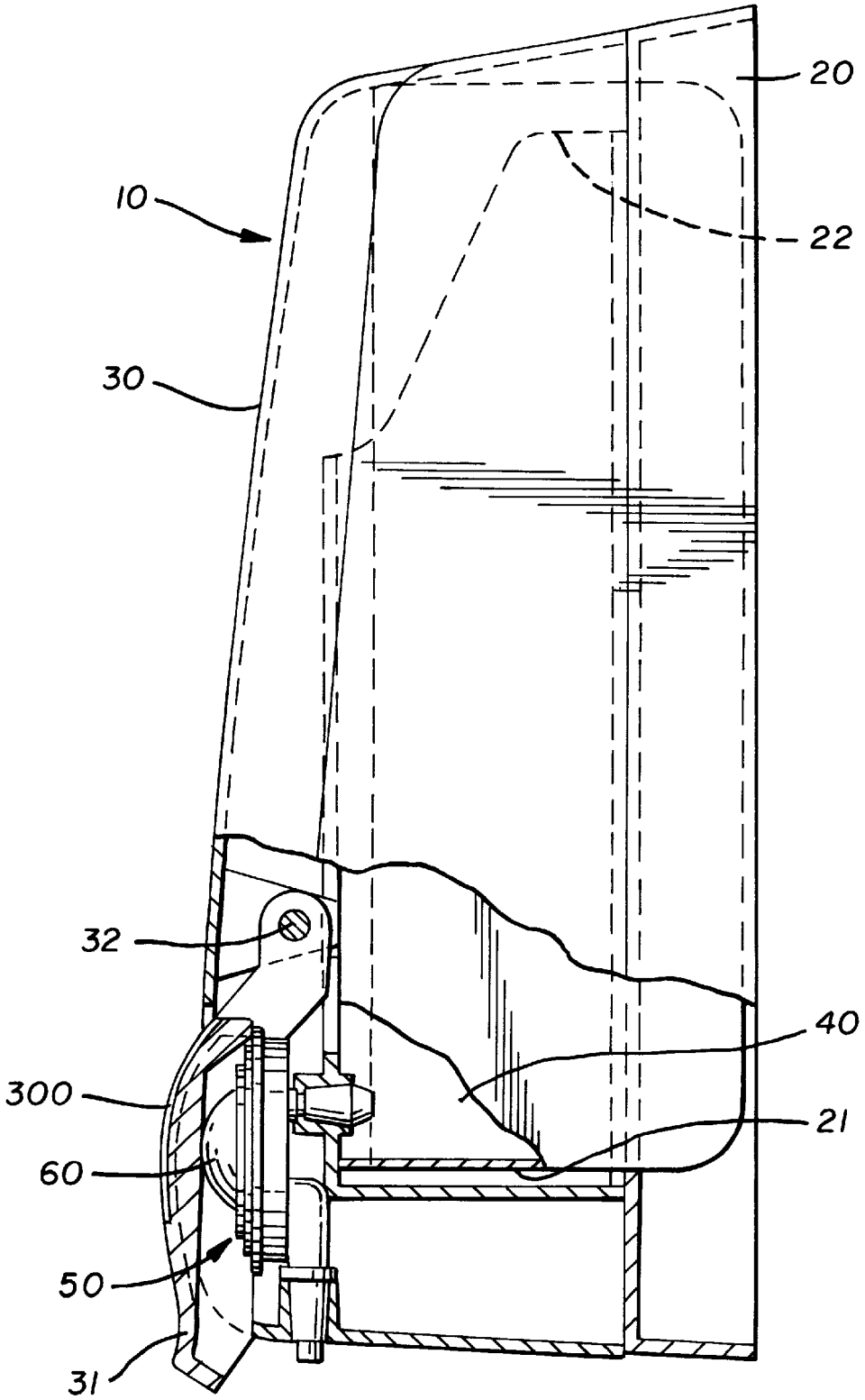
FIG. 3 is a side elevation, partially broken away, showing the interaction between the handle or lever of the dispenser and the pump.

FIGS. 1 through 3 of the drawings show a dispenser of the general type in which the improved pump of the present invention would be used.

It should be noted that the dispenser, which is generally indicated by the numeral 10, is intended to be exemplary only and the present pump could operate with equal efficiency in other designs of dispensers.

Turning then to FIGS. 1 through 3 of the drawings, it will be noted that the dispenser 10 generally includes a base 20, which is intended to be mounted on a wall or other vertical surface, and a cover 30 which is pivotally secured to the base so that it can be opened for replacement of the refill or cartridge which is illustrated as a collapsible bag 40 containing the soap and which is received within the illustrated dispenser 10 on ledge or shelf 21 and retained by bag holders 40. Alternatively, the bag 40 could be carried by the conventional box. Pivotally affixed to the cover 30 is a handle or push member 31 which is intended to be engaged by the hand of the user to activate the pump and dispense the soap.

With reference to FIG. 3 of the drawings, it will be seen that this handle is pivotally mounted to the cover, as at 32, so that it may be moved inwardly toward the base 20 in order to collapse or activate the pump, as will be described below. As suggested earlier, in some dispenser designs, the handle 31 could be eliminated and the pump itself could be engaged by the user's hand. In either case, the operation of the pump and its advantages remain the same.

Interiorly of the dispenser 10 and mounted on the base 20 is a shelf or ledge 21 with upwardly extending sidewalls 22, and it is believed apparent that the bag or other type of reservoir containing the soap, generally indicated by the numeral 40, may be removably supported thereon.

The valve means, generally indicated by the numeral 50, are affixed to this bag and activated by the lever 31, as will be described below.

Figure 4:
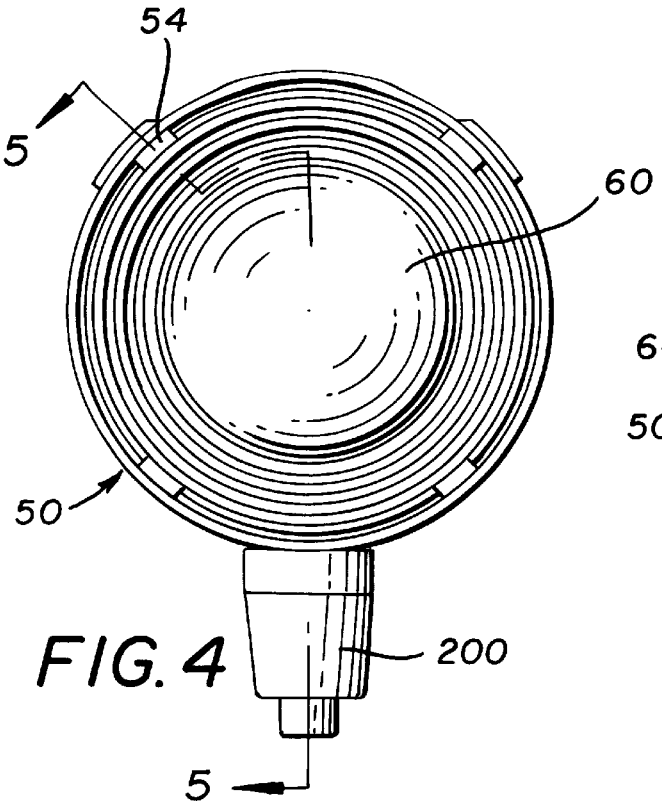
FIG. 4 is a top plan view of the assembled pump.

Turning then to FIGS. 4, 5, 6 and 7 of the drawings for a more detailed description of the valve means 50, it will be seen that the valve means 50 includes a base 51. The base 51 generally includes a bottom wall 51*a* and an upstanding peripheral wall 51*b*. It will be noted here that, as can be seen in FIG. 4, the base is generally circular in configuration as illustrated, but it will be understood that the particular configuration of the base need not necessarily to be limited to that precise shape.

Base 51 also has a recess 51*c* spaced inwardly from the wall or flange 51*b* and extending around the circumference of the base 51 for receipt of the flexible dome 60, as will be described below.

A first connector 52 projects from the bottom wall 51*a* of the base 51 and has a through bore 52*a*. In this fashion, as can be seen in FIG. 3 of the drawings, the first connector 52 can be secured to the bag or reservoir 40 in fluid communication therewith. Preferably, the first connector is molded as an integral part of the base, thereby eliminating the multiplicity of parts and the assembly operations required in the prior art in which a separate connector must be affixed to one end of the conventional tube.

Figure 5:
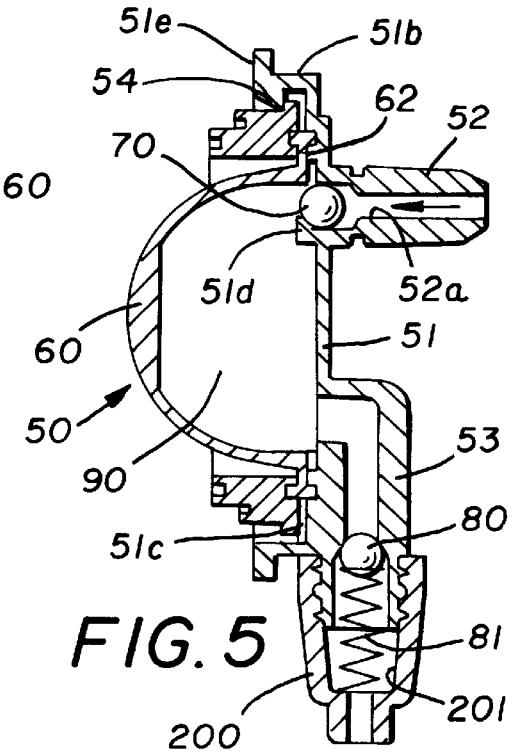
FIG. 5 is a sectional view taken along the line 5—5 of FIG. 4.
Figure 6:
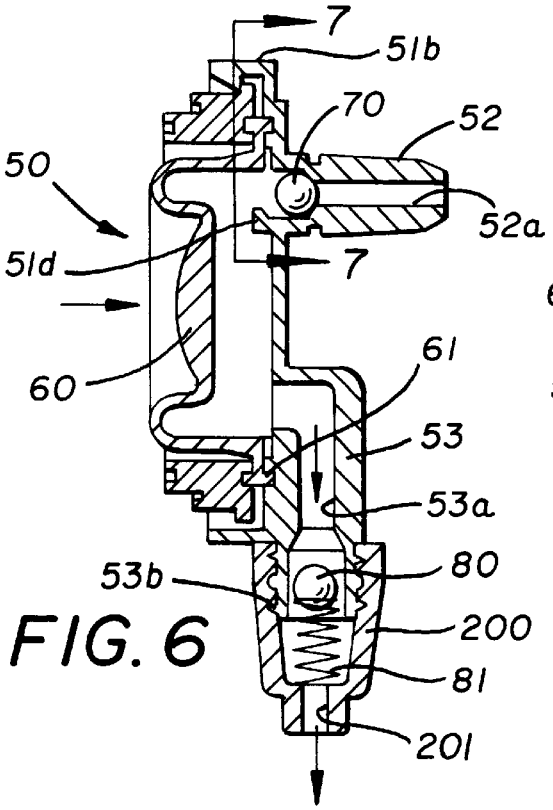
FIG. 6 is a view similar to FIG. 5 showing the pump in the collapsed or dispensing condition.
Figure 7:
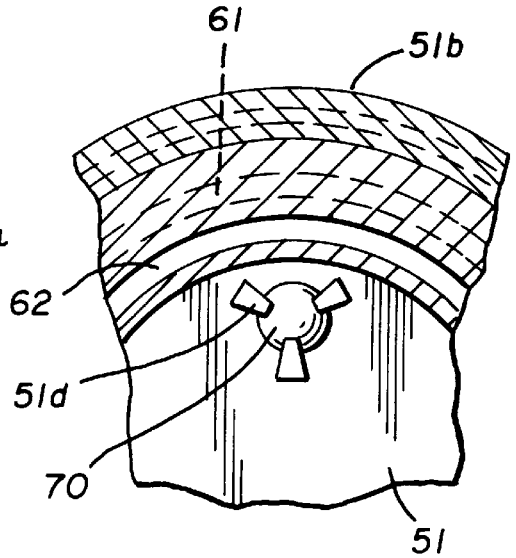
FIG. 7 is a sectional view taken along the line 7—7 of FIG. 6.

Projecting upwardly from the bottom wall 51*a* of the base also are one or more ribs 51*d* which are generally L-shaped in cross-section so that their short legs overlie the base, as can be seen in FIGS. 4, 5 and 6 of the drawings, thus forming a cage for the ball 70. The ball 70 is received in the space between the overlying legs of the ribs 51*d* and the in board end of the through passageway 52*a* of the first connector 52. The ball is sized so that, when seated, as shown in FIG. 6 of the drawings, it will close off the through bore 52*a*, thereby prohibiting soap from entering the pump from the bag or cartridge. Conversely, when unseated, soap may be drawn into the chamber formed by base 51 and flexible dome 60.

A second connector 53 also projects from the bottom wall 51*a* of base 51 and also has a through bore 53*a*. It will be noted that the bore 53*a* opens into the interior of the chamber formed by the flexible dome 60 and the base 51 in a position 180° from the position of the bore 52*a*. Thus, the axis of the through passage 53*a* is then disposed normally to the axis of the bore 52*a*. Here again, the second connector is preferably molded as an integral part of the base, thereby eliminating the need for an additional piece and its assembly to the end of the usual tube as is the case with the prior art.

Received within the second connector 53 is a second valve, and this type of valve, as illustrated, is a ball and spring arrangement in which the ball 80 is supported on a spring 81 so that, for example, in FIG. 5, the spring seats the ball to close off the bore 53*a* to prevent discharge from the interior of the pump. However, depression of the flexible dome 60, as shown in FIG. 6 of the drawings, creates pressure which unseats the ball against the force of the spring and permits the soap to be dispensed.

The flexible dome 60 is intended to be a generally hemispherical, flexible material, preferably transparent so that one can view whether there is soap within the pump 50 from the exterior of the dispenser.

This flexible dome 60 seats on the base 51 to form an interior chamber 90 therewith and is constructed so as to provide a fluid-tight seal therewith. To that end, the flexible dome 60 includes a shoulder 61 which extends around its circumference and which is sized so as to seat within the recess 51*c* of the base, as shown in FIGS. 5 and 6. This shoulder fits into recess 51*c*.

A retaining ring 100 is also provided. This ring has an annular lip 101 extending about its periphery and a central opening 103. Flexible dome 60 has an annular recess 62 in the top surface of shoulder 61. The retaining ring 100 fits over the shoulder 61 of the flexible dome and has an annular projecting lip 101 which fits into the recess 62 formed in the top of the shoulder 61.

The base wall 51*b* of the base also has one or more radially inwardly extending tabs 54 which are L-shaped when viewed in cross-section with the depending portion of the ribs seating on the lip 101 of retaining ring 100. In this way, a secure, fluid-tight seal is achieved about the chamber 90 once the flexible pressure member and retaining ring have been snapped into place.

Figure 8:
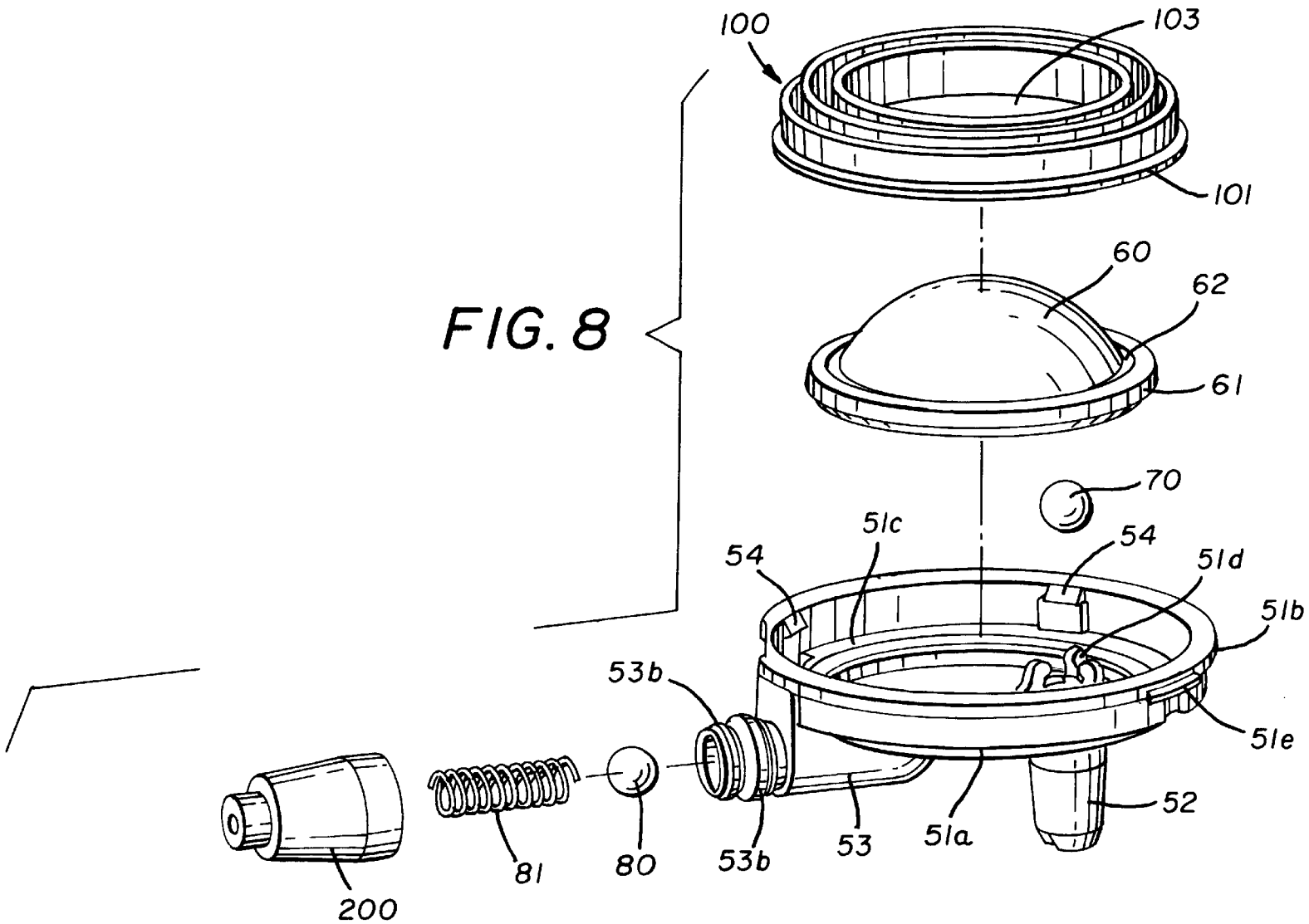
FIG. 8 is an exploded view of the improved pump.

The second connector 53 projects beyond the wall 51*b* of the base 50. It is intended to receive a nozzle, and it will be noted that two different versions of nozzles are illustrated in the drawings. FIGS. 3 through 6 illustrate one version, and another version is illustrated in FIG. 8 of the drawings.

In either event, the second connector has a projecting end which has a series of ribs 53*b* projecting from its periphery. The nozzle 200 is intended to be fitted over the projecting end of the second connector 53 and has appropriate recesses on its interior service so as to engage the ribs 53*b*,53*b*. This arrangement insures a fluid-tight seal between the nozzle and the connector so as to avoid dripping and both the loss of soap and an unsightly nozzle projecting from the dispenser.

In use or operation of the improved device, and assuming that the bag or other reservoir has been inserted into the dispenser 10 and the pump has its connector 52 secured to the bag or reservoir, depressing and releasing the flexible dome 60 will cause the ball 70 to unseat and the chamber 90 to fill up with a predetermined amount of soap.

Upon actuation of the handle or lever 31, which rests against the pressure member 60 as can be seen in FIG. 3, the collapsible pressure member 60 will collapse toward base 51, as can be seen by comparing FIGS. 5 and 6. The pressure caused by this motion will seat the ball 70 and open the ball 80 against the force of spring 81, thereby permitting the soap to be dispensed.

It should be understood here that it is contemplated that it would not be absolutely necessary to utilize a dispenser of the type illustrated in FIGS. 1 through 3 of the drawings and that the lever 31 could be dispensed with and the user could directly contact the pressure member 60 with his or her hand to cause the depression.

Additionally, it will be noted that, when pressure is released on the handle or lever 31 and thus on the pressure member 60, it will, by nature of its flexibility, return to the condition of FIG. 5, creating a reduced pressure within chamber 90 and permitting the ball 80 to seat and the ball 70 to open, thereby permitting refill of the pump chamber 90.

FIGS. 1 and 2 illustrate one of the significant advantages of the invention. In that regard, a clear window 300 is disposed in the operating lever 31. The purpose here is to have this window overlie the flexible dome 60. Inasmuch as these are both transparent, it is thus possible to view the contents of the chamber 90 and thus of the bag through these windows. This accomplishes two functions. First, it is common in this industry to dispense various products, and those various products have generally different pigments added to them so that soap may be of a pink color, while lotion may be creamy ivory-type or some other color. In this fashion, when viewing through the window 300 and thus through the clear dome 60, one can, at a glance, ascertain the nature of the contents. Second, this enables one to view the contents of the chamber 90 to ascertain whether or not the supply of soap or other material in the dispenser has been exhausted. If there is soap visible through the windows in the pumping apparatus itself, then the dispenser is operational for at least one more hand washing. If none is viewed, it may be safely assumed that the dispenser is totally empty and the bag needs to be replaced. It will also be noted that, because of the configuration of the pumping mechanism of the invention, it is possible to locate it adjacent the bottom edge of the bag. In this fashion, one no longer would need to guess whether or not the bag is nearly empty.

Obviously, furthermore, this ability to position the pumping mechanism at the ultimate bottom and to replace the usual tube arrangement with this pumping assembly makes it possible to utilize a standard size container and supply a bag with a much greater capacity because the space usually allotted for the conventional tube is no longer required for that purpose. It has been found that the resulting increase in bag capacity can be in the order of fifty percent. Inasmuch as a major expense in this field is labor cost, this enables the maintenance personnel to more quickly and accurately ascertain the need for refills and it also makes it possible to economically provide more of a supply of the material with each refill, thereby reducing the total number of times that the dispenser needs attention by the maintenance personnel. This makes the refill operation much more efficient.

While a full and complete description of the invention has been set forth in accordance with the dictates of the patent statutes, it should be understood that modifications can be resorted to without departing from the spirit hereof or the scope of the appended claims.

Thus, while the pump of the present invention has been illustrated and described as being utilized in connection with a bag-in-box cartridge or simply with a collapsible bag alone, it is also believed to have utility with other types of containers, such as, for example, bottles.

Furthermore, while the pump has been illustrated and described in connection with a dispenser holding a single source of supply of fluid, it could also be employed with dispensers holding more than one.

What is claimed is:

1. A pump for use with a source of fluid, comprising:

a) a pump base;

b) a first connector attached to and projecting from said base for attachment to the source of fluid;

c) said base having through outlet means in fluid communication with the ambient atmosphere;

d) said first connector being hollow for fluid communication between the source of fluid and said pump base;

e) said connector and said through outlet means having their axes disposed in planes substantially normal to each other;

f) first valve means carried by said pump base for selectively closing off and opening said first connector to fluid communication and g) a flexible pressure member 1) attached to said base in overlying, fluid-tight relationship therewith and 2) forming a chamber with said base whereby, upon collapse of said pressure member, fluid within said chamber is expelled therefrom through said through outlet and, upon expansion of said pressure member, fluid is drawn into said chamber from the source of fluid.

2. The pump of claim 1 wherein said flexible pressure member is transparent.

3. The pump of claim 1 wherein said source of fluid is a collapsible bag.

4. The pump of claim 1 wherein said first valve means include a ball movable into and out of engagement with said first connector.

5. The pump of claim 4 wherein said base has a bottom wall; and at least one rib projecting upwardly from said bottom wall and disposed adjacent the point of connection of said first connector with said base; and said ball is loosely held between said at least one rib and said bottom wall.

6. The pump of claim 5 wherein said at least one rib is integral with said base.

7. The pump of claim 1 wherein a second connector is carried by and projects from said pump base in fluid communication with said through outlet means, and second valve means are disposed within said second connector for selectively opening and closing said first connector to fluid communication.

8. The pump of claim 7 wherein said second valve means includes a spring received within said second connector; and a ball engaged with said spring.

9. The pump of claim 1 wherein said flexible pressure member is generally configured as a hemisphere.

10. The pump of claim 9 wherein said flexible pressure member has a flattened area at its apex.

11. The pump of claim 9 or claim 10 wherein said flexible pressure member is transparent.

12. The pump of claim 1 wherein a) said base has i) an upstanding peripheral flange and ii) a recess spaced inwardly from said flange;

b) said pressure member has a peripheral shoulder sized to fit partially within said recess; and c) a retaining ring is provided with a recess for engagement with said shoulder when said pressure member is partially received with said recess of said base.

13. The pump of claim 12 wherein at least one radially inwardly extending engagement lug is provided on said upstanding peripheral flange of said base for engagement with said retaining ring when said pressure member and said retaining ring are seated in said base.

14. The pump of claim 13 wherein said retaining ring has a peripheral groove for engagement with said at least one engagement lug.

15. The pump of claim 1 wherein said second connector includes an elongate hollow body interconnecting said base and the atmosphere; the projecting end of said elongate body including annular rib means on its external surface; and a nozzle is releasably received on said projecting end.

16. The pump of claim 15 wherein said rib means include a series of three annular ribs; and said nozzle includes mating internal recesses for releasable engagement with said rib means on said projecting end of said second connector.

17. A pump for use with a source of fluid, comprising:

a) a pump base;

b) a transparent flexible pressure member attached to said base in overlying relationship therewith to form, together with said base, a fluid-tight chamber;

c) a first connector 1) projecting from said pump base, and 2) adapted to be attached to the source of fluid in fluid communication therewith and with said chamber;

d) a second connector projecting from said pump base in fluid communication with said chamber and the ambient atmosphere; and e) first and second valve means associated with said first and second connectors, respectively 1) whereby said first and second connectors can be selectively opened and closed in response to collapse and expansion of said flexible pressure member.

18. A pump for use with a source of fluid, comprising:

a) a base for attachment to the source of fluid;

b) a flexible dome receivable on said base to form a fluid-receiving chamber between said base and said dome;

c) a retaining ring releasably engaging said base and said flexible dome to form a fluid-tight seal therebetween; and d) said base having a through bore for fluid communication with the ambient atmosphere.

19. A fluid dispenser, source of fluid and pump combination, comprising:

a) a dispenser housing including 1) a back plate, and 2) a cover hingedly connected to said back plate for movement between an open and a closed position;

b) said back plate and said cover creating a chamber for receipt of the source of fluid when said cover is in said closed position;

c) a pump including 1) a pump base;

2) means for attaching said pump base to the source of fluid, and 3) inlet means in fluid communication with the source of fluid, and 4) outlet means in fluid communication with the ambient atmosphere;

d) said pump including a transparent flexible dome; and e) said transparent flexible dome being visible and accessible through said cover.

20. A pump for use with a source of fluid, comprising:

a) a base having an inlet opening for connection to the source of fluid and an outlet opening for communication with the ambient atmosphere;

b) a flexible transparent dome receivable on the base to form a fluid-tight chamber therewith; and c) a retaining member attachable to the base in partial overlying relationship with said flexible transparent dome.

21. The pump of claim 20 further characterized by the presence of valves disposed adjacent said inlet and outlet openings.

22. A pump for use with a source of fluid, comprising:

a) a base for attachment to the source of fluid;

b) a flexible dome receivable on said base to form a fluid receiving chamber between said base and said dome;

c) a retainer disposed on said dome for engagement with said base to form a fluid-tight seal between said base and said dome; and d) said base having a through bore for fluid communication with the ambient atmosphere.

* * * * *

US006216916C1

(12) EX PARTE REEXAMINATION CERTIFICATE (5881st)

United States Patent

Maddox et al.

(10) Number: US 6,216,916 C1

(45) Certificate Issued: Sep. 4, 2007

(54) COMPACT FLUID PUMP

(75) Inventors: Jeffrey T. Maddox, Hudson, OH (US); Rexford R. Mast, Wooster, OH (US); Robert H. Yeager, Twinsburg, OH (US)

(73) Assignee: Joseph S. Kanfer, Richfield, OH (US)

Reexamination Request:
No. 90/007,137, Jul. 28, 2004

Reexamination Certificate for:

| | |
|---|---|
| Patent No.: | **6,216,916** |
| Issued: | **Apr. 17, 2001** |
| Appl. No.: | **09/397,314** |
| Filed: | **Sep. 16, 1999** |

(51) Int. Cl.
*B65D 35/56* (2006.01)

(52) U.S. Cl. ..... 222/105; 222/183; 222/207; 222/214

(58) Field of Classification Search ..... 285/354, 285/921; 137/539; 239/570, 571, 584; 222/156, 222/158, 159, 207
See application file for complete search history.

(56) References Cited

U.S. PATENT DOCUMENTS

| | | | | | |
|---|---|---|---|---|---|
| 1,305,964 | A | * | 6/1919 | Dickson | 137/469 |
| 1,489,310 | A | * | 4/1924 | Critchlow | 251/149.6 |
| 1,656,763 | A | * | 1/1928 | Sibley | 141/383 |
| 1,671,609 | A | * | 5/1928 | Roberts | 137/539 |
| 1,735,784 | A | * | 11/1929 | Olson | 222/211 |
| 1,781,681 | A | * | 11/1930 | Cooke | 137/539 |
| 2,605,022 | A | * | 7/1952 | Nieland | 222/159 |
| 2,752,199 | A | * | 6/1956 | Newell, Jr. | 239/327 |
| 2,789,734 | A | * | 4/1957 | Biederman | 222/207 |
| 2,896,683 | A | * | 7/1959 | Mena | 137/539 |
| 2,979,234 | A | * | 4/1961 | Kamborian | 222/146.5 |
| 3,162,333 | A | * | 12/1964 | Davidson | 222/207 |
| 3,207,369 | A | * | 9/1965 | Rossi | 222/23 |
| 3,335,750 | A | * | 8/1967 | Kepner | 137/515.5 |
| 3,343,564 | A | * | 9/1967 | Peeples et al. | 137/539 |
| 3,709,437 | A | * | 1/1973 | Wright | 239/343 |
| 3,963,150 | A | * | 6/1976 | Steiman et al. | 222/211 |
| 3,973,701 | A | * | 8/1976 | Gardner | 222/190 |
| 4,159,790 | A | * | 7/1979 | Bailey | 222/211 |
| 4,254,897 | A | * | 3/1981 | Stocks | 222/159 |
| 4,330,071 | A | * | 5/1982 | Ohlson | 222/207 |
| 4,345,627 | A | * | 8/1982 | Cassia | 141/18 |
| 4,349,129 | A | * | 9/1982 | Amneus | 222/41 |
| 4,573,612 | A | * | 3/1986 | Maddison et al. | 222/105 |
| 4,867,347 | A | * | 9/1989 | Wass et al. | 222/153.13 |
| 4,966,312 | A | * | 10/1990 | Waring | 222/209 |
| 5,020,529 | A | * | 6/1991 | Gobin | 128/202.28 |
| 5,099,885 | A | * | 3/1992 | Nilsson | 137/852 |
| 5,105,990 | A | * | 4/1992 | Leith | 222/156 |
| 5,176,510 | A | * | 1/1993 | Nilsson | 417/479 |
| 5,248,066 | A | * | 9/1993 | Olson et al. | 222/105 |
| 5,465,877 | A | * | 11/1995 | Bell et al. | 222/181.2 |
| 5,474,541 | A | * | 12/1995 | Ritsky et al. | 604/213 |
| 5,713,874 | A | * | 2/1998 | Ferber | 604/198 |
| 5,810,204 | A | * | 9/1998 | Devlin et al. | 222/82 |
| 5,829,640 | A | * | 11/1998 | Hershey et al. | 222/153.13 |
| 5,833,124 | A | * | 11/1998 | Groves et al. | 222/158 |
| 5,848,993 | A | * | 12/1998 | Tanhehco et al. | 604/217 |
| 5,918,776 | A | * | 7/1999 | Atkinson | 222/207 |
| 5,967,377 | A | * | 10/1999 | Glynn | 222/158 |
| 5,996,851 | A | * | 12/1999 | Dolan et al. | 222/179 |
| 6,152,330 | A | * | 11/2000 | Polan | 222/156 |

FOREIGN PATENT DOCUMENTS

| | | | | |
|---|---|---|---|---|
| DE | 3430646 | A1 | * | 3/1985 |
| EP | 0 413 642 | A1 | * | 2/1991 |
| GB | 2155435 | A | * | 9/1985 |

* cited by examiner

*Primary Examiner*—Aaron J. Lewis

(57) ABSTRACT

A pump for dispensing fluid from a dispenser includes a base in fluid communication with a source of fluid carried by the dispenser and with the atmosphere. The pump includes a base attachable to the source of fluid, a flexible transparent dome attachable to the base in overlying relationship therewith and in fluid-tight relationship, and a retainer attachable to the base in partial overlying relationship with the dome to retain the dome on the base. The pump also includes valves for selectively opening and closing the pump to fluid communication with the source of fluid and the ambient atmosphere.

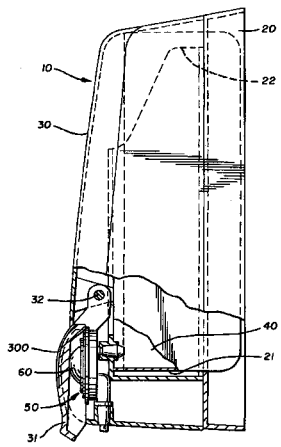

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 19 is confirmed.

Claims 2, 11, 12, 17, 18 and 20–22 are cancelled.

Claims 1, 3–10, 13 are determined to be patentable as amended.

Claims 14–16, dependent on an amended claim, are determined to be patentable.

1. A [pump for use with a] *fluid dispenser,* source of fluid *and pump combination*, comprising:

*a pump including:* a) a pump base;

b) a first connector attached to and projecting from said base for attachment to the source of fluid;

c) said base having through outlet means in fluid communication with the ambient atmosphere;

d) said first connector being hollow for fluid communication between the source of fluid and said pump base;

e) said connector and said through outlet means having their axes disposed in planes substantially normal to each other;

f) first valve means carried by said pump base for selectively closing off and opening said first connector to fluid communication [and]

g) a *transparent* flexible pressure member 1) attached to said base in overlying, fluid-tight relationship therewith and 2) forming a chamber with said base whereby, upon collapse of said pressure member, fluid within said chamber is expelled therefrom through said through outlet and, upon expansion of said pressure member, fluid is drawn into said chamber from the source of fluid*; and*

*a fluid dispenser including;*

*a) a backplate; and*

*b) a cover secured to said backplate, said pump being retained between said backplate and cover, said transparent flexible pressure member being viewable through said cover.*

3. The [pump] *combination* of claim 1 wherein said source of fluid is a collapsible bag.

4. The [pump] *combination* of claim 1 wherein said first valve means include a ball movable into and out of engagement with said first connector.

5. The [pump] *combination* of claim 4 wherein said base has a bottom wall; and at least one rib projecting upwardly from said bottom wall and disposed adjacent the point of connection of said first connector with said base; and said ball is loosely held between said at least one rib and said bottom wall.

6. The [pump] *combination* of claim 5 wherein said at least one rib is integral with said base.

7. The [pump] *combination* of claim 1 wherein a second connector is carried by and projects from said pump base in fluid communication with said through outlet means, and second valve means are disposed within said second connector for selectively opening and closing said first conector to fluid communication.

8. The [pump] *combination* of claim 7 wherein said second valve means includes a spring received within said second connector; and a ball engaged with said spring.

9. The [pump] *combination* of claim 1 wherein said flexible pressure member is generally configured as a hemisphere.

10. The [pump] *combination* of claim 9 wherein said flexible pressure member has a flattened area at its apex.

13. [The] *A* pump [of claim 12] *for use with a source of fluid comprising:*

*a) a pump base having*

*i) an upstanding peripheral flange and*

*ii) a recess spaced inwardly from said flange;*

*b) a first connector attached to and projecting from said base for attachment to the source of fluid;*

*c) said base having through outlet means in fluid communication with the ambient atmosphere;*

*d) said first connector being hollow for fluid communication between the source of fluid and said pump base;*

*e) said connector and said through outlet means having their axes disposed in planes substantially normal to each other;*

*f) first valve means carried by said pump base for selectively closing off and opening said first connector to fluid communication*

*g) a transparent flexible pressure member having a peripheral shoulder sized to fit partially within said recess of said pump base; and*

*h) a retaining ring having a recess that engages said peripheral shoulder when said pressure member is partially received within said recess of said base such that said transparent flexible pressure member is attached to said base in overlying, fluid-tight relationship therewith and forms a chamber with said base whereby, upon collapse of said pressure member, fluid within said chamber is expelled therefrom through said through outlet and, upon expansion of said pressure member, fluid is drawn into said chamber from the source of fluid,* wherein at lease one radially inwardly extending engagement lug is provided on said upstanding peripheral flange of said base for engagement with said retaining ring when said pressure member and said retaining ring are seated in said base.

* * * * *